US007437941B1

(12) United States Patent
Ward

(10) Patent No.: US 7,437,941 B1
(45) Date of Patent: Oct. 21, 2008

(54) HEATING AND AIR CONDITIONING SERVICE GAUGE

(75) Inventor: Charles Barry Ward, Alpharetta, GA (US)

(73) Assignee: Diversitech Corporation, Duluth, GA (US)

( * ) Notice: Subject to any disclaimer, the term of this patent is extended or adjusted under 35 U.S.C. 154(b) by 0 days.

(21) Appl. No.: 11/743,374

(22) Filed: May 2, 2007

Related U.S. Application Data

(60) Provisional application No. 60/746,720, filed on May 8, 2006.

(51) Int. Cl.
*G01L 9/00* (2006.01)

(52) U.S. Cl. ..... 73/753

(58) Field of Classification Search ..... 73/700–756
See application file for complete search history.

(56) References Cited

U.S. PATENT DOCUMENTS 6,553,777 B2 * 4/2003 Dillenback ..... 62/171
6,983,889 B2 * 1/2006 Alles ..... 236/49.1
7,012,223 B2 * 3/2006 Kopel ..... 219/494
7,119,308 B2 * 10/2006 Kopel ..... 219/494
7,219,506 B2 * 5/2007 Kang et al. ..... 62/176.6

OTHER PUBLICATIONS

DRSA-1100 User Manual, Digi-Cool Industries Ltd., Digital Refrigeration System Analyzer, Copyright 2004, Digi-Cool Industries Ltd.
Web pages from www.digi-cool.com showing various types of refrigeration products dated Jul. 18, 2007.
Datasheet regarding the DRSA-1200 Digital Refrigeration System Analyzer, Digi-Cool Industries Ltd.
DRSA-1200 User Manual, Digi-Cool Industries Ltd., Digital Refrigeration System Analyzer, Copyright 2007, Digi-Cool Industries Ltd.
Datasheet regarding the DRSA-1000 Digital Refrigeration System Analyzer, Digi-Cool Industries Ltd.
Datasheet regarding the DRSA-1100 Digital Refrigeration System Analyzer, Digi-Cool Industries Ltd.

* cited by examiner

*Primary Examiner*—Andre J. Allen
*Assistant Examiner*—Jermaine Jenkins
(74) *Attorney, Agent, or Firm*—Smith, Gambrell & Russell LLP

(57) ABSTRACT

A pressure gauge for determining refrigerant pressure and refrigerant saturated vapor equivalent temperature for a refrigerant in an HVAC system.

4 Claims, 1 Drawing Sheet

Typical HVACR Gauge with refrigerant scales in blue.

HEATING AND AIR CONDITIONING SERVICE GAUGE

CLAIM OF PRIORITY

This application claims priority from U.S. Provisional Patent Application Ser. No. 60/746,720 filed on May 8, 2006, which is incorporated herein in its entirety.

FIELD OF THE INVENTION

This invention relates to a service gauge used for installing and servicing an HVAC system.

BACKGROUND OF THE INVENTION

HVAC service personnel must measure the system refrigerant pressure in order to install or service a HVAC system. This measurement is accomplished with an analog pressure gauge. Typically, the gauges are mechanical and contain a curved tube, which bends in response to the applied pressure. Connected to the tube are series of watch-like gears that connect and rotate the indicating needle located on the front of the gauge.

Gauges can either be permanently attached to the equipment or incorporated into portable tools or manifolds. Normally, a manifold or gauge manifold holds two gauges for pressure measurement and includes valves for installation or removal of the refrigerant from the HVAC system.

Typically, two gauges with different pressure ranges are used for the basic pressure measurements of the refrigerant. The main analog scale of each gauge indicates pressure in PSI (pounds per square inch) or KPa (metric Kilo-Pascals). Additional inner analog scales are also printed on the face of the gauge. The additional inner scales (circular bands of numbers) indicate the saturated vapor equivalent temperature for different refrigerants. Because of the limited space on the gauge face, only two or three different inner scales for different refrigerants can fit onto the face of any one gauge. FIG. 1 shows a typical prior art pressure gauge.

The saturated vapor equivalent temperature scale of the gauge is of importance to the technician because the saturated vapor equivalent temperature indicated on the gauge for the particular refrigerant is used to ascertain the temperatures in parts of the system during charging, servicing, or monitoring. The correct inner gauge scale must be matched to the type of refrigerant in the system. If the gauge does not have an analog scale that matches the refrigerant in the system being serviced, the technician must consult a table that converts the pressure read on the gauge to the saturated vapor equivalent temperature. Because HVAC systems respond very slowly and the pressure and the saturated vapor equivalent temperature must be continuously monitored during refrigerant charging, the use of a lookup chart is inconvenient, time consuming, and error prone.

SUMMARY OF THE INVENTION

In order to solve the problems of the prior art analog gauges with limited space on the face for printing analog scales or other relevant information, the present invention comprises a pressure gauge with a digital display that can display refrigerant pressure and refrigerant saturated vapor equivalent temperature for a large number of different refrigerants as well as the instantaneous or time variation of the refrigerant pressure or the refrigerant saturated vapor equivalent temperature.

The pressure gauge of the present invention includes a sensor that measures changes in refrigerant pressure and produces an electronic pressure signal that is proportional to the measured refrigerant pressure. A battery powered microprocessor within the gauge receives the electronic pressure signal, converts the electronic pressure signal to a refrigerant pressure value in PSI or KPa, and digitally displays the refrigerant pressure value on the face of the gauge. In addition, the microprocessor can convert the refrigerant pressure value to a refrigerant saturated vapor equivalent temperature value (in Fahrenheit or Celsius) for the particular refrigerant being used in the HVAC system. Moreover, the pressure gauge of the present invention can produce an analog trend graph showing the change of refrigerant pressure or refrigerant saturated vapor equivalent temperature over time in order to give the technician a clear understanding of the operation of the system as the HVAC system progresses to a steady state condition. Further, the microprocessor can generate and display a bar graph that shows rapid fluctuations of the refrigerant pressure that can indicate a bad compressor valve or other system problems.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 1:
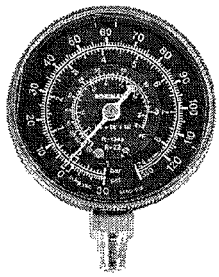
Fig 1 (Prior Art)
FIG. 1 is a front elevation view of a prior art pressure gauge.
Figure 2:
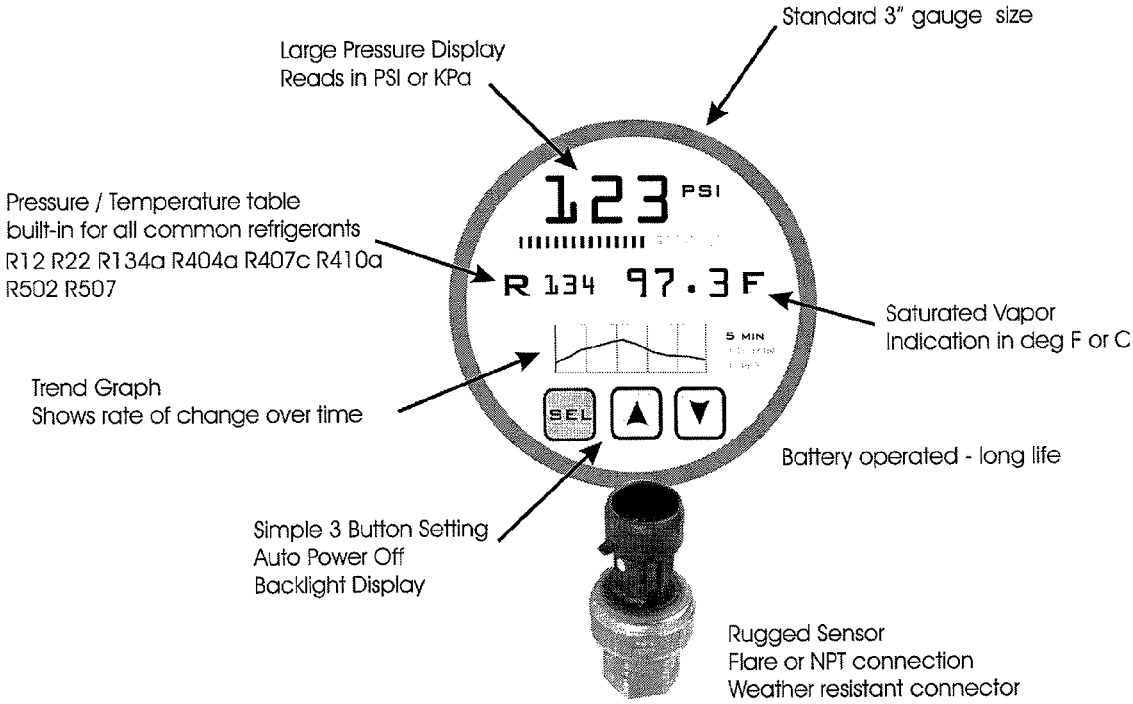
FIG. 2 is a front elevation view of a pressure gauge in accordance with present invention.

FIG. 2 shows a display for an electronic pressure gauge in accordance with the present invention. The size and shape of the pressure gauge is similar to the conventional prior art gauge shown in FIG. 1. The pressure gauge of the present invention comprises a pressure sensor that is in communication with a refrigerant pressure line of the HVAC system (not shown). The pressure sensor produces an electronic pressure signal that is proportional to the refrigerant pressure in the refrigerant line of the HVAC system. The pressure sensor is connected to a microprocessor powered by a battery. The microprocessor, including related electronics and software, converts the electronic pressure signal to a refrigerant pressure value that is shown on the display. For a particular refrigerant in the HVAC system, the microprocessor converts the electronic pressure signal to a refrigerant saturated vapor equivalent temperature value that is likewise shown on of the display.

From the refrigerant pressure value, the microprocessor can also calculate and render a bar chart of the instantaneous refrigerant pressure on the display. Also, the microprocessor can calculate and render on the display a time lapsed refrigerant pressure or a time lapsed refrigerant saturated vapor equivalent temperature for a preselected time period.

The pressure sensor, battery, display, and microprocessor are contained within the pressure gauge.

The pressure gauge of the present invention can also include an external temperature probe that produces an electronic temperature signal that is proportional to the temperature sensed by the temperature probe. From the electronic temperature signal, the microprocessor can calculate and render a temperature value on the display.

Further, the pressure gauge may include an wired or wireless output port for connection to a computer, PDA, cell phone, or the like for capture of gauge data for storage or further analysis.

Several advantages are readily apparent. The refrigerant pressure (in PSI or KPa) is shown in large easy to read digits on the display. A bar graph, below the refrigerant pressure display, shows rapid pressure fluctuations that can indicate bad compressor valve or other system problems.

The next line of the display shows the refrigerant type for the HVAC system being serviced. The technician selects the refrigerant type, and the microprocessor in the pressure gauge calculates the saturated vapor equivalent temperature using an internal table of all popular refrigerants and displays the saturated vapor equivalent temperature in degrees (Fahrenheit or Celsius).

The lower display area is a trend chart that shows a time lapsed view of the refrigerant pressure or the refrigerant saturated vapor equivalent temperature. Total trend time shown on the display can be selected in 3 ranges of 5 minutes, 30 minutes, and 1 hour.

Three buttons located below the display allow the technician to select refrigerant type, English or metric display, high or low pressure operational range, chart timing options, and backlight operations. Pressing any key turns on the gauge and illuminates the backlight.

An external temperature probe can be connected to the gauge of the present invention in order to measure and display refrigerant temperature, superheat, or sub-cool system parameters.

While this invention has been described with reference to preferred embodiments thereof, it is to be understood that variations and modifications can be affected within the spirit and scope of the invention as described herein and as described in the appended claims.

I claim:

1. A pressure gauge for determining refrigerant pressure and refrigerant saturated vapor equivalent temperature for a refrigerant in an HVAC system comprising:

a. a pressure sensor connected to the HVAC system for producing an electronic pressure signal proportional to the refrigerant pressure in the HVAC system;

b. a microprocessor for receiving the electronic pressure signal and programmed to:

i. calculate a refrigerant pressure value of the refrigerant from the electronic pressure signal; and ii. calculate a refrigerant saturated vapor equivalent temperature value from the refrigerant pressure value for the refrigerant in the HVAC system; and c. a display connected to the microprocessor for showing the calculate refrigerant pressure value and the calculated refrigerant saturated vapor equivalent temperature value.

2. The pressure gauge of claim 1, wherein the microprocessor further calculates a series of the instantaneous refrigerant pressure value and renders a graph of the instantaneous refrigerant pressure values on the display.

3. The pressure gauge of claim 1, wherein the microprocessor further generates a trend line of the refrigerant pressure value or the refrigerant saturated vapor equivalent temperature value over a preselected time period and renders the trend line for the preselected time period on the display.

4. The pressure gauge of claim 1, wherein the pressure gauge further includes a temperature sensor that produces an electronic temperature signal proportional to temperature of the refrigerant in the HVAC system and wherein the microprocessor calculates a temperature value for the refrigerant and renders the refrigerant temperature value on the display.

* * * * *